US009776765B2

(12) United States Patent
Stephens et al.

(10) Patent No.: US 9,776,765 B2
(45) Date of Patent: Oct. 3, 2017

(54) MEDICATION DISPENSING SYSTEM

(71) Applicants: Carlisle Stephens, Bridgeport, CT (US); Mary Stephens, Bridgeport, CT (US)

(72) Inventors: Carlisle Stephens, Bridgeport, CT (US); Mary Stephens, Bridgeport, CT (US)

( * ) Notice: Subject to any disclaimer, the term of this patent is extended or adjusted under 35 U.S.C. 154(b) by 0 days.

(21) Appl. No.: 14/992,077

(22) Filed: Jan. 11, 2016

(65) Prior Publication Data

US 2017/0197756 A1 Jul. 13, 2017

(51) Int. Cl.

| | |
|---|---|
| ***B65D 23/12*** | (2006.01) |
| ***A61J 1/03*** | (2006.01) |
| ***B65D 1/04*** | (2006.01) |
| ***B65D 43/16*** | (2006.01) |
| ***B65D 51/24*** | (2006.01) |
| ***B65D 41/02*** | (2006.01) |
| ***B65D 47/06*** | (2006.01) |
| ***A45F 3/16*** | (2006.01) |

(52) U.S. Cl.

CPC ..... *B65D 23/12* (2013.01); *A45F 3/16* (2013.01); *A61J 1/03* (2013.01); *B65D 1/04* (2013.01); *B65D 41/02* (2013.01); *B65D 43/16* (2013.01); *B65D 47/06* (2013.01); *B65D 51/245* (2013.01)

(58) Field of Classification Search

CPC ..... A45F 3/16; A61J 1/03; A61J 1/035; A61J 7/04; B65D 1/04; B65D 21/02; B65D 23/12; B65D 41/02; B65D 43/16; B65D 47/06; B65D 51/245; B65D 77/00; B65D 83/04; B65D 83/00; A47G 19/22

USPC ..... 206/217, 223, 528, 534, 540; 215/6

See application file for complete search history.

(56) References Cited

U.S. PATENT DOCUMENTS

| | | | | |
|---|---|---|---|---|
| 1,275,467 | A * | 8/1918 | Poulalion | A61J 7/0046 215/6 |
| 2,493,922 | A * | 1/1950 | Miller | B65D 23/12 206/528 |
| 3,514,008 | A | 5/1970 | Dorn | |
| 5,238,140 | A | 8/1993 | Maze | |
| 5,489,026 | A * | 2/1996 | D'Aloia | B65D 21/0238 206/528 |
| 6,419,081 | B1 | 7/2002 | Ross | |
| 6,488,146 | B1 * | 12/2002 | Dotsikas | A61J 7/0046 206/217 |
| 6,681,958 | B2 | 1/2004 | Sorenson et al. | |
| D566,472 | S | 4/2008 | Kramer | |
| D684,354 | S | 6/2013 | Boggeano | |
| 8,550,240 | B2 | 10/2013 | Marcus et al. | |
| 9,636,279 | B2 * | 5/2017 | Song | A61J 1/03 |
| 2005/0045519 | A1 * | 3/2005 | Hirsch | A61J 7/04 206/534 |

(Continued)

FOREIGN PATENT DOCUMENTS

NL 1011767 A * 6/1999 ..... B65D 83/04

*Primary Examiner* — Bryon Gehman

(57) ABSTRACT

A medication dispensing system includes a fluid and a plurality of pills. A bottle is provided and the fluid is contained within the bottle. The bottle has an outer wall and an inner wall. The inner wall defines a plurality of compartments with respect to the outer wall. Each of the compartments is fluidly discrete from an interior of the bottle. Each of the pills is removably positioned within an associated one of the compartments and each of the pills may be selectively consumed in conjunction with the fluid.

4 Claims, 3 Drawing Sheets

(56) References Cited

U.S. PATENT DOCUMENTS

| | | | | |
|---|---|---|---|---|
| 2008/0296181 | A1* | 12/2008 | Stephens | A47G 23/16 206/217 |
| 2012/0248004 | A1* | 10/2012 | Naghavi | B65D 25/04 206/538 |
| 2012/0285243 | A1 | 11/2012 | Yamamoto | |
| 2014/0360966 | A1 | 12/2014 | Howard | |
| 2015/0210462 | A1* | 7/2015 | Milani | A61J 1/03 206/570 |
| 2016/0198874 | A1* | 7/2016 | Pisarevsky | A61J 7/04 206/217 |

* cited by examiner

MEDICATION DISPENSING SYSTEM

BACKGROUND OF THE DISCLOSURE

Field of the Disclosure

The disclosure relates to dispensing devices and more particularly pertains to a new dispensing device for combining a beverage bottle with a pill container.

SUMMARY OF THE DISCLOSURE

An embodiment of the disclosure meets the needs presented above by generally comprising a fluid and a plurality of pills. A bottle is provided and the fluid is contained within the bottle. The bottle has an outer wall and an inner wall. The inner wall defines a plurality of compartments with respect to the outer wall. Each of the compartments is fluidly discrete from an interior of the bottle. Each of the pills is removably positioned within an associated one of the compartments and each of the pills may be selectively consumed in conjunction with the fluid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
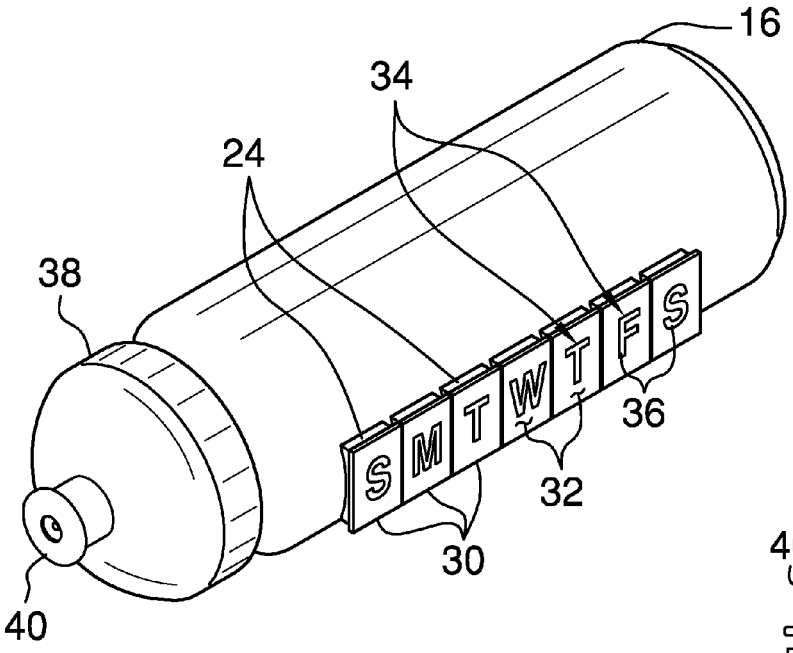
FIG. 1 is a perspective view of a medication dispensing system according to an embodiment of the disclosure.
Figure 2:
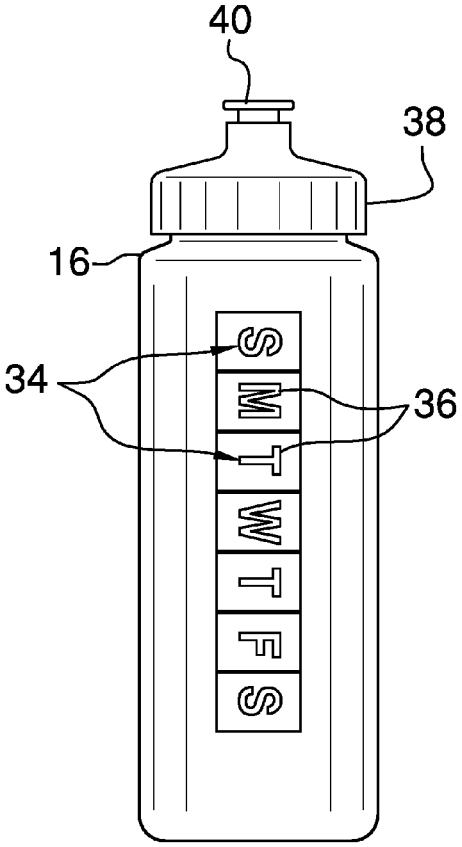
FIG. 2 is a front view of an embodiment of the disclosure.
Figure 3:
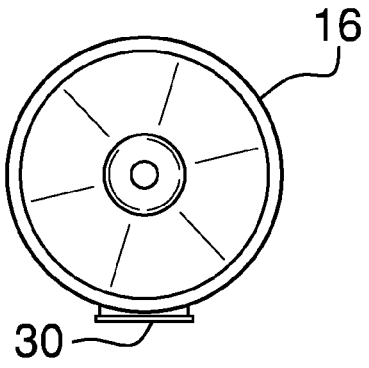
FIG. 3 is a top view of an embodiment of the disclosure.

With reference now to the drawings, and in particular to FIGS. 1 through 5 thereof, a new dispensing device embodying the principles and concepts of an embodiment of the disclosure and generally designated by the reference numeral 10 will be described.

As best illustrated in FIGS. 1 through 5, the medication dispensing system 10 generally comprises a fluid 12 that may be consumed. The fluid comprises a potable beverage such as water or the like. A plurality of pills 14 is provided. The pills 14 may comprise medication to be taken according to a pre-determined schedule. A bottle 16 is provided and the fluid 12 is contained within the bottle 16.

The bottle 16 has an outer wall 18 and an inner wall 20. The inner wall 20 is spaced from the outer wall 18 to define a plurality of compartments 22 with respect to the outer wall 18. Each of the compartments 22 is fluidly discrete from an interior of the bottle 16. Each of the pills 14 is removably positioned within an associated one of the compartments 22. Thus, each of the pills 14 may be selectively consumed in accordance with the pre-determined schedule.

The inner wall 20 is positioned within the bottle 16. Each of the compartments 22 has a peripheral wall 24 extending away from the inner wall 20. The peripheral wall 24 completely surrounds the corresponding compartment 22. The peripheral wall 24 of each of the compartments 22 extends outwardly through the outer wall 18. The peripheral wall 24 of each of the compartments has a distal edge 26 with respect to the inner wall 20. The distal edge 26 defines an opening 28 into the each of the compartments 22 and the compartments 22 are distributed longitudinally along the bottle 16.

A plurality of lids 30 is provided and each of the lids 30 is hingedly coupled to an associated one of the compartments 22. Each of the lids 30 is positioned on the distal edge 26 of the associated compartment 22. Thus, lid 30 selectively opens and closes the opening of the associated compartment 22.

Each of the lids 30 has an outwardly facing surface 32. Indicia 34 is printed the outwardly facing surface 32. The indicia 34 comprise letters 36 corresponding to days of a calendar week. Each of the lids 30 has an associated one of the letters 36 printed thereon. Thus, each of the compartments 22 is assigned to the corresponding day of the week.

A cap 38 is removably coupled to the bottle 12 such that the cap 38 retains the fluid 12 within the bottle 16. The cap 38 has a nozzle 40 extending outwardly therefrom and the nozzle 40 may be manipulated. The nozzle 40 may comprise a fluid valve or the like and the nozzle 40 is in fluid communication with an interior of the bottle 16. Thus, the nozzle 40 selectively releases the fluid 12 from the bottle 16 thereby facilitating the fluid 12 to be consumed.

Figure 4:
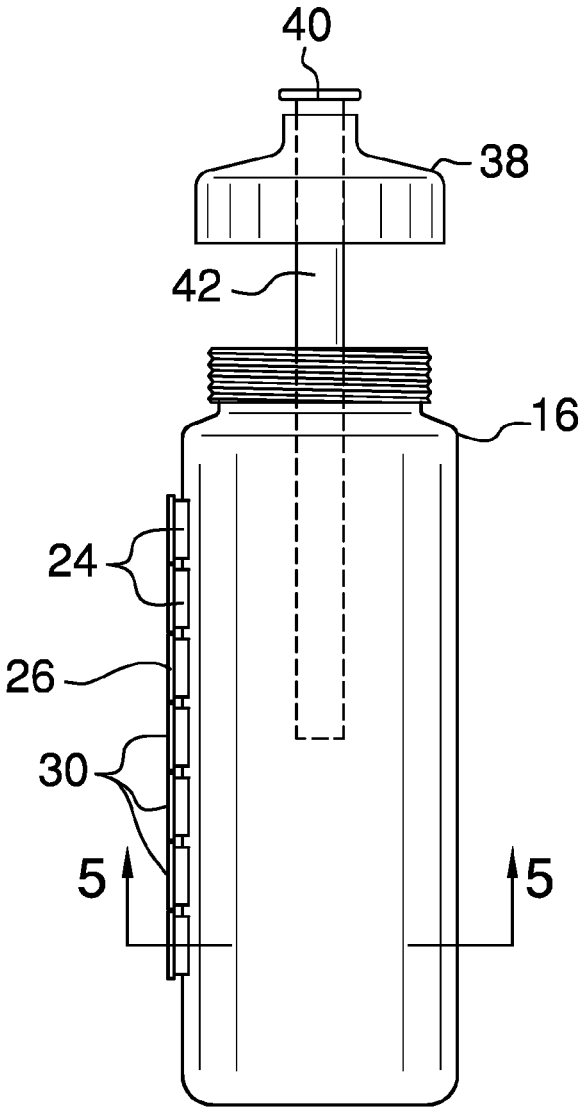
FIG. 4 is a left side view of an embodiment of the disclosure.
Figure 5:
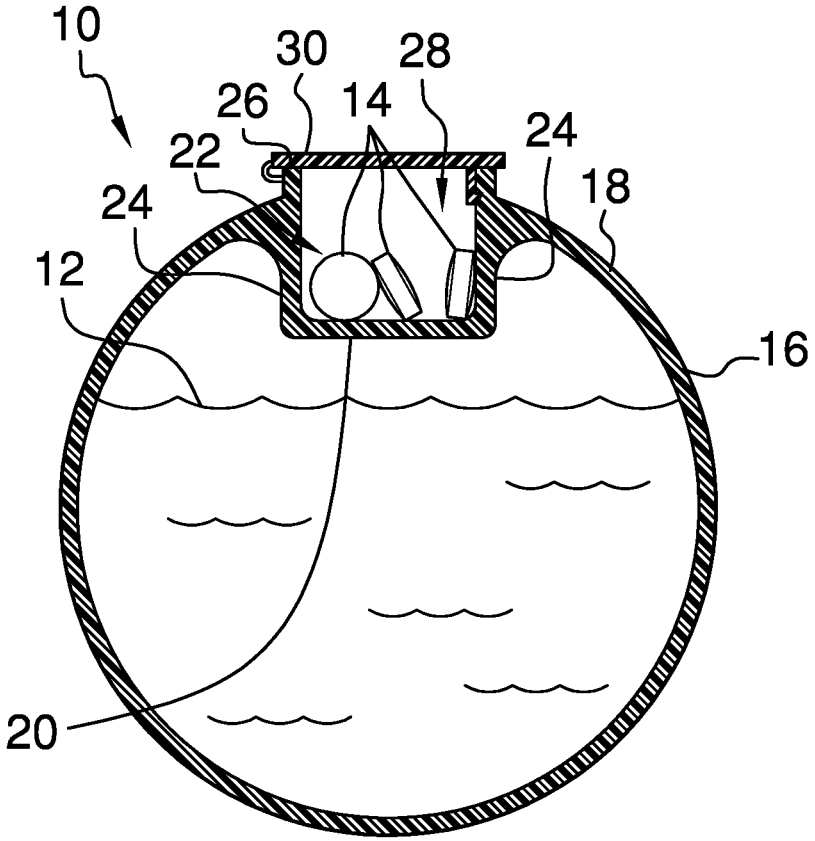
FIG. 5 is a cross sectional view taken along line 5-5 of FIG. 4 of an embodiment of the disclosure.

The bottle 16 may comprise a portable water bottle of any conventional design. For example, as shown in FIG. 4, a straw 42 may extend downwardly from the nozzle 40. The straw 42 may be submerged in the fluid 12 and the straw 42 is fluidly coupled to the nozzle 40. Thus, the fluid 12 may be suctionally urged upwardly through the straw 42 to be consumed. The nozzle 40 may be any nozzle used in the convention of portable water bottles.

In use, the bottle 16 is filled with the fluid 12 and the cap 38 is attached to the bottle 16. The pills 14 are divided into groups and each of the groups is positioned within an associated compartment 22. The groups are arranged to correspond to the days of the calendar week. The pills 14 in each of the compartments 22 are consumed on the corresponding day of the calendar week. The fluid 12 is consumed when the pills 14 are consumed. Thus, the fluid 12 aids the pills 14 to be swallowed. The compartments 22 ensure the fluid 12 is always available to aid with swallowing the pills 14.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A medication dispensing system comprising:

a fluid comprising a potable beverage;

a plurality of pills; and a bottle having said fluid being contained therein wherein said bottle is configured to facilitate drinking of said fluid, said bottle having an outer wall and an inner wall, said inner wall defining a plurality of compartments with respect to said outer wall, each of said compartments being fluidly discrete from an interior of said bottle, each of said pills being removably positioned within an associated one of said compartments, wherein said inner wall is positioned within said bottle, each of said compartments having a peripheral wall extending away from said inner wall, said peripheral wall corresponding to each of said compartments extending outwardly through said outer wall such that said peripheral wall corresponding to each of said compartments has a distal edge with respect to said inner wall, said distal edge of each said peripheral wall being outwardly offset from said outer wall of said bottle, each said distal edge defining an opening into said corresponding compartment, said distal edges being coplanar, adjacent, and linearly aligned wherein said compartments are distributed along a longitudinal axis of said outer wall of said bottle.

2. The system according to claim 1, further comprising a plurality of lids, each of said lids being hingedly coupled to an associated one of said compartments, each of said lids being positioned on said distal edge of said associated compartment such that lid selectively opens and closes said opening of said associated compartment, each of said lids having an outwardly facing surface, said outwardly facing surface of each of said lids having indicia being printed thereon, said indicia comprising letters corresponding to days of a calendar week.

3. The system according to claim 1, further comprising a cap being removably coupled to said bottle such that said cap retains said fluid within said bottle, said cap having a nozzle extending outwardly therefrom, said nozzle being in fluid communication with an interior of said bottle, said nozzle selectively releasing said fluid from said bottle wherein said fluid is configured to be drank.

4. A medication dispensing system comprising:

a fluid comprising a potable beverage;

a plurality of pills;

a bottle having said fluid being contained therein wherein said bottle is configured to facilitate drinking of said fluid, said bottle having an outer wall and a inner wall, said inner wall defining a plurality of compartments with respect to said outer wall, each of said compartments being fluidly discrete from an interior of said bottle, each of said pills being removably positioned within an associated one of said compartments, wherein said inner wall is positioned within said bottle, each of said compartments having a peripheral wall extending away from said inner wall, said peripheral wall corresponding to each of said compartments extending outwardly through said outer wall such that said peripheral wall corresponding to each of said compartments has a distal edge with respect to said inner wall, said distal edge of each said peripheral wall being outwardly offset from said outer wall of said bottle, each said distal edge defining an opening into said corresponding compartment, said distal edges being coplanar, adjacent, and linearly aligned wherein said compartments are distributed along a longitudinal axis of said outer wall of said bottle;

a plurality of lids, each of said lids being hingedly coupled to an associated one of said compartments, each of said lids being positioned on said distal edge of said associated compartment such that lid selectively opens and closes said opening of said associated compartment, each of said lids having an outwardly facing surface, said outwardly facing surface of each of said lids having indicia being printed thereon, said indicia comprising letters corresponding to days of a calendar week; and a cap being removably coupled to said bottle such that said cap retains said fluid within said bottle, said cap having a nozzle extending outwardly therefrom, said nozzle being in fluid communication with an interior of said bottle, said nozzle selectively releasing said fluid from said bottle wherein said fluid is configured to be drank.

* * * * *